United States Patent [19]

Scherf et al.

[11] 3,983,685

[45] Oct. 5, 1976

[54] YARN-TWISTING APPARATUS PROVIDED WITH THREAD-WETTING MEANS

[75] Inventors: Siegfried Scherf, Gremmendorf, Munster; Aloys Greive, Munster; Aloys Treus, Havixbeck; Heinrich Eckholt, Munster; Aloys Horstmann, Greven, all of Germany

[73] Assignee: Hamel GmbH Zwirnmaschinen, Munster, Germany

[22] Filed: July 21, 1975

[21] Appl. No.: 597,777

[30] Foreign Application Priority Data

July 19, 1974 Germany ..... 2434899

[52] U.S. Cl. ..... 57/35; 57/58.49; 57/58.84; 57/164

[51] Int. Cl.[2] ..... D01H 13/30; D01H 7/86

[58] Field of Search ..... 57/35, 58.49, 58.83, 57/58.84, 58.86, 106, 108, 164, 58.7

[56] References Cited

UNITED STATES PATENTS

| | | | |
|---|---|---|---|
| 3,159,962 | 12/1964 | Franzen | 57/58.49 |
| 3,222,857 | 12/1965 | Keyser | 57/35 |
| 3,295,305 | 1/1967 | Nimtz | 57/35 X |
| 3,310,934 | 3/1967 | Franzen | 57/58.84 |
| 3,400,528 | 9/1968 | Nimtz et al. | 57/35 |
| 3,423,922 | 1/1969 | Smith | 57/35 |
| 3,563,019 | 2/1971 | Greive et al. | 57/35 |
| 3,864,901 | 2/1975 | Beymes et al. | 57/35 |

*Primary Examiner*—John Petrakes
*Attorney, Agent, or Firm*—Karl F. Ross; Herbert Dubno

[57] ABSTRACT

A thread is pulled off a yarn package and down past a thread brake into a spindle shaft forming part of a rotating structure. The thread exits at the bottom of the shaft from a radial opening in a payoff disk having a frustoconical surface formed with a peripheral groove. The thread passes from below across this groove and is then pulled up between the yarn package and a ballon-limiting cylinder. A reservoir disposed next to this structure is filled with a treatment liquid feeding an applicator whose upper end projects into the groove in the payoff disk. A wick in the applicator tube conducts the liquid up to the tip of the tube and moistens the thread as it passes periodically between this tip and the rotating disk.

10 Claims, 3 Drawing Figures

32
34
76
36
38
30
40
28
24
26
25
23
N S
N S
22
41
16
18
54
56
52
II
46
14
62
48
20
42
44
A
12
α
60
58
50
10

YARN-TWISTING APPARATUS PROVIDED WITH THREAD-WETTING MEANS

CROSS-REFERENCE TO RELATED APPLICATION

This application is related to commonly assigned and copending patent application Ser. No. 364,552 filed 29 May 1973 by one of us, Aloys Greive, now U.S. Pat. No. 3,938,309.

FIELD OF THE INVENTION

Our present invention relates to a yarn-twisting apparatus having means for applying a liquid treatment agent to a thread pulled off a yarn package.

BACKGROUND OF THE INVENTION

A great deal of dust is usually produced in the twisting of filaments in double-thread twisters, in particular when mixtures of natural and synthetic fibers are being used. This is caused by the friction of the thread balloon against a balloon-limiting cylinder surrounding the spindle. The dust is formed by many broken fiber ends which find their way into the machine and thereby degrade the quality of the yarn being produced. In addition, a portion of this dust is conducted by the so-called balloon wind into the area around the machine so as to contaminate the atmosphere. Twisting of filaments with a high coefficient of friction and the use of a balloon-limiting cylinder also increases the stresses on the filament so as further to increase the production of dust. This increased longitudinal stressing of the filament gives a high-quality product but also greatly increases the chance of filament breakage and, therefore, down-time of the machine.

It has been suggested (see German printed specification No. 1,510,521) to provide on the outside of each balloon-limiting cylinder of each spindle a reservoir for a wetting agent that is applied to the balloon through an opening between the reservoir and the interior of the cylinder. A sponge, a wick, a piece of sintered material or the like is used to conduct the wetting agent from the reservoir to the balloon limiter. All the reservoirs are connected to a supply conduit which continuously or periodically refills them. The wetting agent is therefore applied to the thread in the balloon and smooths it so as to lower the coefficient of friction between the thread and the balloon and, therefore, to decrease the production of dust in this region.

In another known system (see German patent No. 1,259,751) it has been suggested to mount on the top of the spindle a cylindrical upwardly open vessel which is filled with a treatment liquid and which is covered with a porous stopper. Several wicks extend downwardly from the stopper into the bottom of the vessel so as to transport the wetting agent upwardly by capillary action. As the thread is pulled from the spool, it passes over the wetted stopper and picks up some of the treatment liquid.

In the prior systems of which we are aware, the wetting of the thread occurs either at a point (e.g. in the balloon) where a certain amount of dust has already been generated or in a manner which is difficult to control and which therefore leads to irregular moistening and the possible spilling of excess liquid onto adjoining parts of the machinery.

OBJECT OF THE INVENTION

The object of our invention, therefore, is to provide improved means in a yarn twister of the character described for wetting a filament in a controllable manner, especially for minimizing the coefficient of friction between this filament and nearby parts of the apparatus which are to be kept substantially dry.

SUMMARY OF THE INVENTION

In accordance with our invention, a disk forming part of a rotatable thread-guiding structure is provided with a peripheral groove which is bridged by a thread under tension, drawn off a stationary yarn package, as that thread moves across the disk periphery to a point of utilization. A stationary applicator, terminating at the disk periphery with sufficient clearance from the groove bottom to permit passage of the thread therebetween during each revolution of the guide structure, has a tip contacted by the thread upon each passage to wet the thread with a treatment liquid (usually water) from a reservoir communicating with that applicator.

The applicator, pursuant to a more particular feature of our invention, comprises a tube traversed by a wick, the tube being preferably provided with an end cap forming the applicator tip. This end cap may have a rounded face confronting the disk groove and a bore generally parallel to the axis of rotation of the guide structure, an extremity of the wick being received in this bore while a remote end of the wick dips into the reservoir.

If the guide structure here considered is part of a bank of substantially identical structures centered on generally parallel axes of rotation in a common plane, as is the rule in installations of this sort, the reservoir may be common to all the structures and may extend horizontally parallel to that common plane. Each applicator tube may then rise from the reservoir at an angle of about 25° to 45° to the horizontal. With the aid of suitable level-control means in the reservoir, the amount of moisture transferred to the thread on each pass can be closely regulated.

BRIEF DESCRIPTION OF THE DRAWING

The above and other features of our invention will now be described in detail with reference to the accompanying drawing in which.

SPECIFIC DESCRIPTION

Figure 1:
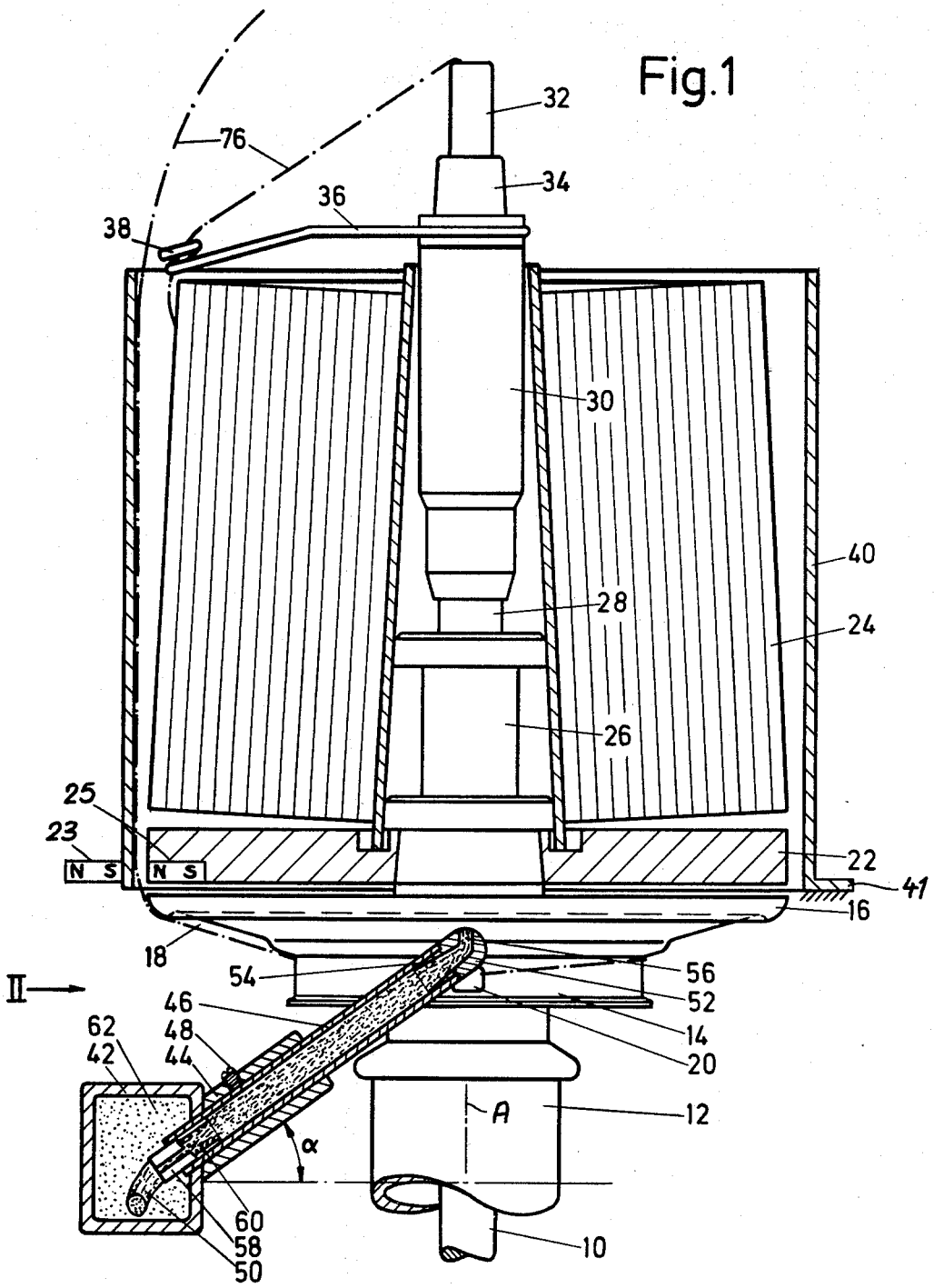
FIG. 1 is a vertical section through a portion of a system according to this invention.
Figure 2:
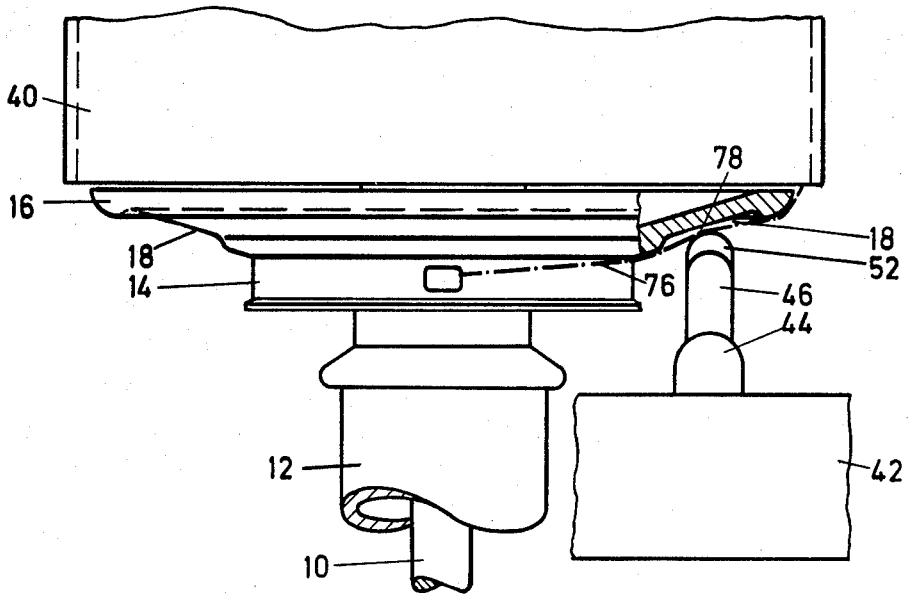
FIG. 2 is a fragmentary elevational view taken in the direction of arrow II of FIG. 1.

The apparatus shown in FIGS. 1 and 2 has a spindle shaft 10 centered on a vertical axis A and rotationally fixed to a whorl 12 driven through a belt by a motor (not shown). Also rotationally fixed to the shaft 10 and whorl 12 is a payoff disk 16 substantially as described in commonly assigned U.S. Pat. No. 3,563,019. This payoff disk 16 has a downwardly converging frustoconical peripheral surface provided with a circumferential groove 18. A cylindrical drum 14, constituting a downward extension of disk 16, has a radial hole 20 which communicates with a passage extending axially through the rotating structure and through a stationary platter 22 supporting a yarn package 24; platter 22 is journaled on the shaft 16 and is held against rotation by means of coacting magnets 23 and 25. The holding magnet 23 is carried on a balloon-limiting cylinder 40 surrounding the package 24 with radial clearance on a fixed support indicated schematically at 41.

Rising from platter 22 is a centering tube 26 for the yarn package 24, traversed by a carrying tube 28 which is equipped with a thread brake 30 as described in the aforementioned U.S. Pat. No. 3,563,019. A head 34 on top of the brake 30 carries an inlet tube 32. All the parts 22, 40, 26, 28, 30, 34 and 32 are centered on the axis A.

Figure 3:
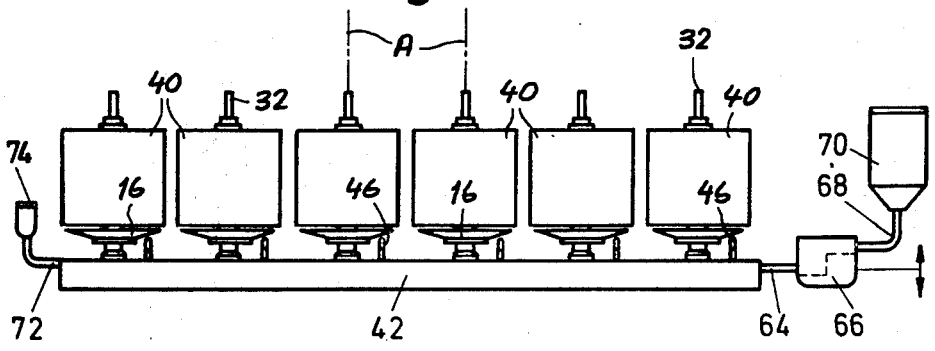
FIG. 3 is a side view of a multispindle system conforming to FIGS. 1 and 2.

A bank of twisters of the type shown in FIG. 1 are mounted next to one another as indicated in FIG. 3, with their axes A all parallel and coplanar. A liquid reservoir 42, constituted by a horizontal conduit of rectangular cross-section, extends alongside these structures parallel to their common axial plane and carries several sleeves 44, one for each package support, extending upwardly therefrom at an angle of inclination $\alpha$ ranging between about 25° and 45°. Each sleeve 44 surrounds an applicator tube 46 adjustably held therein by means of a setscrew 48. A felt wick 50 inserted into each tube 46 extends from an end cap 52 on the upper end of the tube past its bottom end into the liquid 62 occupying the conduit 42. A resilient sheet-metal split sleeve 58, provided internally with barbs 60, clampingly engages the wick 50 and secures it in place at the lower end of the tube 46. The hemispherical end cap 52 is formed with a tapering passage 54 converging from the interior of tube 46 to an upright cylindrical bore 56 parallel to axis A. All the tubes 46 lie in a plane parallel to the common axial plane of the package supports.

As shown in FIG. 3, the conduit 42 is provided at one end with a bleeder line 72 and a venting valve 74. The other end of this conduit 42 is connected via a feed line 64 to a preferably adjustable level or pressure regulator 66, e.g. of the float-controlled type, communicating through a pipe 68 with a supply container 70. In this manner the interior of the conduit 42 is kept filled with water or other wetting agent 62 maintained at a predetermined pressure.

In operation, a thread 76 is drawn off the package 24 and up through an eye 38 formed at the end of an arm 36 projecting from head 34. This filament 76 passes down through the tube 32, the brake 30 and the tube 26 and exits from the rotating disk through the hole 20. The filament winds itself around part of the drum 14 and then passes upwardly under tension over the frustoconical surface of disk 16, spanning the groove 18. Thereafter the filament rises between the balloon limiter 40 and the package 24 and continues to a nonillustrated takeup spool or the like.

The curved tip of the tube 44 formed by the hemispherical end cap 52 projects into the groove 18 so as to deflect the filament 76 slightly inwardly as indicated at 78 in FIG. 2. Thus this filament 76 periodically sweeps over the upper extremity of wick 50 and picks up a portion of liquid drawn by capillary action from the conduit 42; the same capillary action prevents the liquid from spilling onto any part of the rotating structure 10, 12, 14, 16 after the filament has passed.

What is claimed is:

1. A yarn-twisting apparatus comprising:

a stationary support for a yarn package centered on an axis;

a structure rotatable about said axis, said structure including a disk transverse to said axis and guide means for leading a thread under tension from said yarn package across the periphery of said disk to a point of utilization, said disk being provided with a peripheral groove bridged by said thread;

a stationary applicator for a treatment liquid terminating at the periphery of said disk with sufficient clearance from the bottom of said groove to permit passage of said thread therebetween during each revolution of said structure, said applicator having a tip contacted by said thread upon each passage; and a reservoir of treatment liquid communicating with said applicator.

2. An apparatus as defined in claim 1 wherein said applicator comprises a tube and a wick extending through said tube, said wick having an end remote from said tip located in said reservoir.

3. An apparatus as defined in claim 2 wherein said applicator further comprises an end cap on said tube forming said tip, said end cap having a rounded face confronting said groove and being provided with a bore generally parallel to said axis accommodating an extremity of said wick.

4. An apparatus as defined in claim 3 wherein said bore is narrower than the interior of said tube and diverges frustoconically toward the latter.

5. An apparatus as defined in claim 2 wherein said tube is provided with resilient clamping means for adjustably gripping said wick.

6. An apparatus as defined in claim 2 wherein said axis is substantially vertical and said tube rises to said reservoir at an angle of about 25° to 45° from the horizontal.

7. An apparatus as defined in claim 2 wherein said reservoir is provided with a sleeve extending toward said disk, said tube being adjustably mounted in said sleeve.

8. An apparatus as defined in claim 1 wherein said structure is part of a bank of substantially identical structures centered on generally vertical axes of rotation in a common plane, said reservoir serving all said structures and extending horizontally parallel to said common plane.

9. An apparatus as defined in claim 8 wherein said reservoir is provided with level-control means for said liquid.

10. An apparatus as defined in claim 1 wherein said axis is generally vertical, further comprising a balloon-limiting cylinder above said disk surrounding said support, said guide means forming an outlet below said disk for a thread passing axially downwardly through said structure to said outlet and thence across said disk upwardly into said cylinder, said disk having a downwardly converting frustoconical surface provided with said groove.

* * * * *